US006893230B2

(12) United States Patent
Sung et al.

(10) Patent No.: US 6,893,230 B2
(45) Date of Patent: May 17, 2005

(54) ROTATION SUPPORT OF HEAT-DISSIPATION FAN

(76) Inventors: Kuan Kuan Sung, 10788 165th St., Surrey, B.C. (CA), V4N 3M1; Edward Cheng, 10788 165th St., Surrey, B.C. (CA), V4N 3M1

( * ) Notice: Subject to any disclaimer, the term of this patent is extended or adjusted under 35 U.S.C. 154(b) by 0 days.

(21) Appl. No.: 10/074,917

(22) Filed: Feb. 14, 2002

(65) Prior Publication Data

US 2003/0152466 A1 Aug. 14, 2003

(51) Int. Cl.[7] ..... F04B 35/04; F04D 29/04
(52) U.S. Cl. ..... 417/354; 416/174; 417/423.12
(58) Field of Search ..... 417/354, 423.12, 417/424.1; 310/90; 416/174; 384/276, 278

(56) References Cited

U.S. PATENT DOCUMENTS 5,380,112 A * 1/1995 Schicktanz et al. ..... 384/278
5,947,704 A * 9/1999 Hsieh ..... 417/423.12
6,254,348 B1 * 7/2001 Lee ..... 416/174
6,447,272 B2 * 9/2002 Tsuchiya ..... 417/354

* cited by examiner

*Primary Examiner*—Michael Koczo, Jr.
(74) *Attorney, Agent, or Firm*—David Peter Alan

(57) ABSTRACT

An improved structure for rotational support for a heat-dissipation fan is disclosed, comprising a hollow ceramic bearing passing through and concentric with the fan rotor and rotating with said rotor, a hollow ceramic support bearing fixedly mounted to the base of the fan, and a hollow or solid ceramic axle tube passing through the inside of said bearing and rotating freely to reduce friction and allow high-speed rotation. The exterior surface of said bearing is ground or otherwise formed to provide better connection with the rotor, while the interior of the bearing and exterior of the axle tube are further processed to reduce contact area therebetween to reduce rotation friction. This improved structure has achieved reduced friction, reduced noise, reduced power consumption, longer life and higher rotational speed.

11 Claims, 5 Drawing Sheets

ROTATION SUPPORT OF HEAT-DISSIPATION FAN

BACKGROUND OF THE INVENTION

The present invention relates to an improved structure for rotational support of a heat-dissipation fan, wherein a ceramic bearing is fixed onto a rotor and rotates with it. Various ceramic axle tube supporting structures are provided, and interior and exterior surfaces of the bearing and axle tube are further processed to reduce rotational friction between them, reduce noise, reduce power consumption, and achieve longer life and allow higher rotational speed.

FIG. 1 is an exploded view of a heat-dissipation fan according to the prior art. Axial shaft 101 is fixedly attached to rotor 100 at one end and surrounded by axle tube 102, supported by either ball bearing 103 or metal sleeve 104. When stator coil 105 is energized to generate impelling magnetic force, the circular permanent magnet installed inside rotor 100 acts upon this magnetic force and rotates the motor. The ball bearing 103 or metal sleeve 104 is a key component of fan rotation in the prior art. Ball bearing 103 has a lower coefficient of friction and longer life than metal sleeve 104, but when dust or debris enters ball bearing 103, resulting bearing friction rapidly causes it to deteriorate; generating vibration, abnormal heat and loud noise. Eventually the fan will become unstable. In addition, the price of a ball bearing is higher than that of alternative bearing structures. Metal sleeve 104 is cheap, but wears out very quickly, requiring regular maintenance and replacement. In the conventional art, when lubricant is consumed, abnormal heat and friction will greatly shorten the life of the fan.

It should be noted that axial shaft 101 is fixed on rotor 100 and rotates with it, while metal sleeve 104 is fixed on the fan base and does not rotate. The friction caused by surface contact between axial shaft 101 and sleeve 104, combined with viscosity of lubricant, offsets the impelling force created by magnetic forces in stator 105. This results in high heat, high friction, reduced rotor speed and wasting of energy.

The present invention is distinct from the prior art. In the present invention, the ceramic bearings used are self-lubricating, as opposed to lubrication by LASER gas (Derrickson, U.S. Pat. No. 4,975,925 (1990) or air (Ghosh, U.S. Pat. No. 5,738,446 (1998)). The present invention uses only ceramic material, as opposed to Schicktanz, U.S. Pat. No. 5,380,112 (1995), which teaches the use of members made of different materials concentrically aligned. Webb, U.S. Pat. No. 6,208,675 (2001) discloses a complex blower and fan mechanism for a LASER, but it uses ball bearings. The present invention uses ceramic bearings, which constitute an improvement. Recent inventions using ceramic bearings all teach a pin or axial tube that is fixedly attached to either the fan rotor or fan base. Examples are Hsieh, U.S. Pat. No. 5,947,704 (1999) (fixed to base), Tsuchiya, U.S. Pat. No. 6,447,272 (2002) (attached to rotor; no claim as to bearing material) and Lee, U.S. Pat. No. 6,254,348 (2001) (center pin also fixed). In the present invention, the axial tube (pin) is received by both the bearing mounted to the rotor and the bearing mounted to the fan base. This arrangement allows the axial tube to rotate when the fan rotor turns, but not at as high a speed. As shall be shown, this is a novel feature of the present invention.

SUMMARY OF THE INVENTION

The object of the present invention is to provide an improved structure for rotational support in a heat-dissipation fan to achieve lower rotational friction. This reduced friction brings the benefits of lower noise, lower power consumption, longer life and higher allowable rotation speed.

In order to achieve these objectives, the present invention provides an improved structure comprising a hollow ceramic bearing passing through and affixed to the fan rotor and rotating with it, and a hollow or solid ceramic tube passing through the inside of the bearing and rotating freely to reduce friction and allow for high speed rotation. The exterior surface of the bearing and the exterior of the axle tube are processed to reduce surface contact area between them, thereby further reducing rotational friction.

The present invention comprises a ceramic hollow tubular bearing, support bearing and axle tube, and a ceramic holding ring. The bearing passes through and is fixedly attached to the fan rotor and rotates with the rotor. The support bearing is fixedly attached to the fan base, acting as structural support, and does not rotate. The axle tube is either cylindrical in shape or contains an end flange portion, forming a T-shaped (in cross-section) tube. The axle tube passes through the inside of the bearing and support bearing, and rotates asynchronously and freely with the fan rotor. The axle tube functions as structural support, providing multi-point contact with the rotating support mechanism. The ceramic holding ring has an opening or gap and is installed at one end of the axle to tube to limit axial movement of the axle tube.

When the heat-dissipation fan is energized and rotating, the bearing rotates with the rotor. The axle tube is then carried forward asynchronously and incrementally, thereby rotating slowly within the bearing. Since the bearing and axle tube are rotating at different speeds in the same direction, friction is reduced and fan speed and efficiency are increased. To avoid movement of the axle tube in the axial direction, a ceramic holding ring (a C-ring) is installed at the end of the axle tube furthest from the fan rotor. The rotating bearing, fixed support bearing, free-moving axle tube and auto balancing of magnetic forces combine to create a very stable high speed rotating support mechanism with multi-point contact, delivering minimum vibration and friction.

The bearing and support bearing are hollow ceramic tubes, the exteriors of which are ground or otherwise formed with a concave surface or a grooved shape, to provide a simple but solid connection with the fan rotor body, suitable for mass production of injection molded fan rotor bodies. The interior of the bearing and support bearing are ground or otherwise formed with concave grooves to further reduce surface contact and friction among the bearing, support bearing and axle tube.

The axle tube is a solid or hollow ceramic tube with a cylindrical shape, or with an end flange portion forming a T-shape (in cross-section). The exterior of the axle tube is ground or otherwise formed with concave grooves or with a non-circular shape to further reduce surface contact and friction among bearing, support bearing and axle tube.

In addition, the gap between bearing/support bearing and axle tube is kept below ten microns in width to prevent vibration and noise.

DETAILED DESCRIPTION OF THE INVENTION

Figure 1:
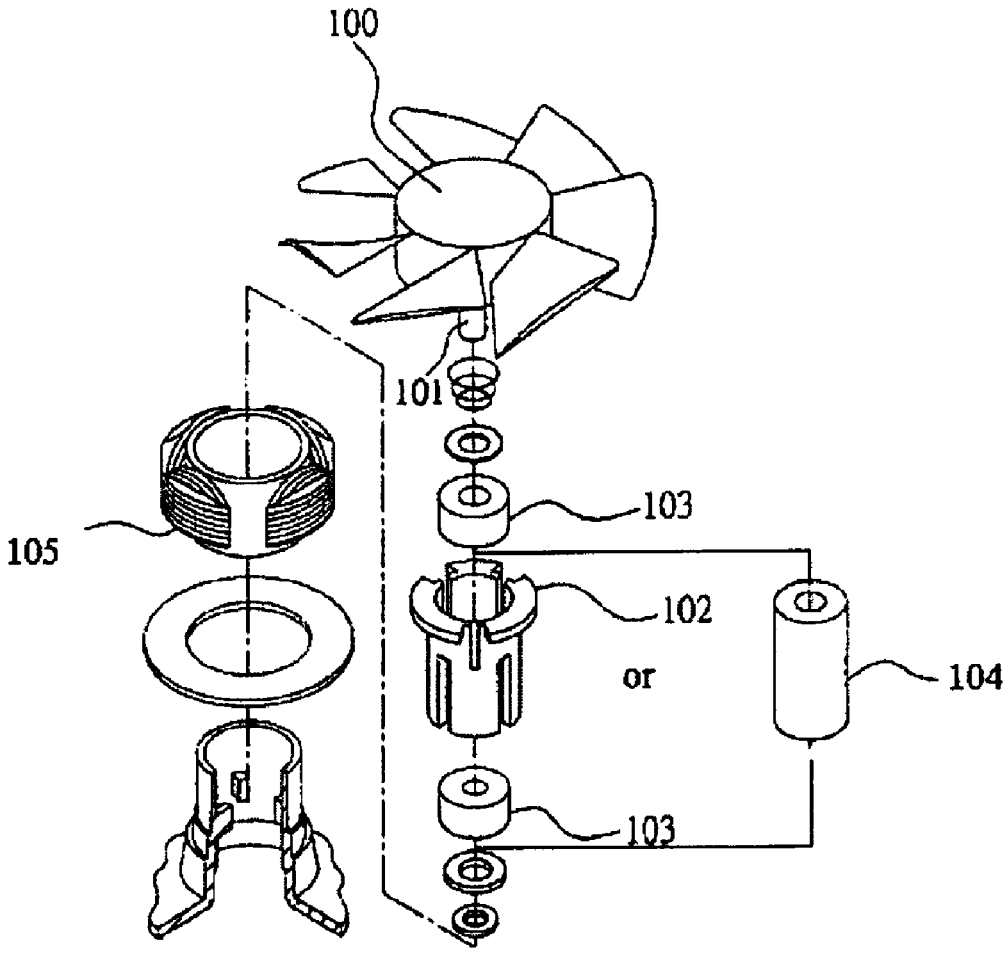
FIG.1 PRIOR ART
FIG. 1 shows an exploded view of a heat-dissipation fan, according to the prior art.
Figure 2:
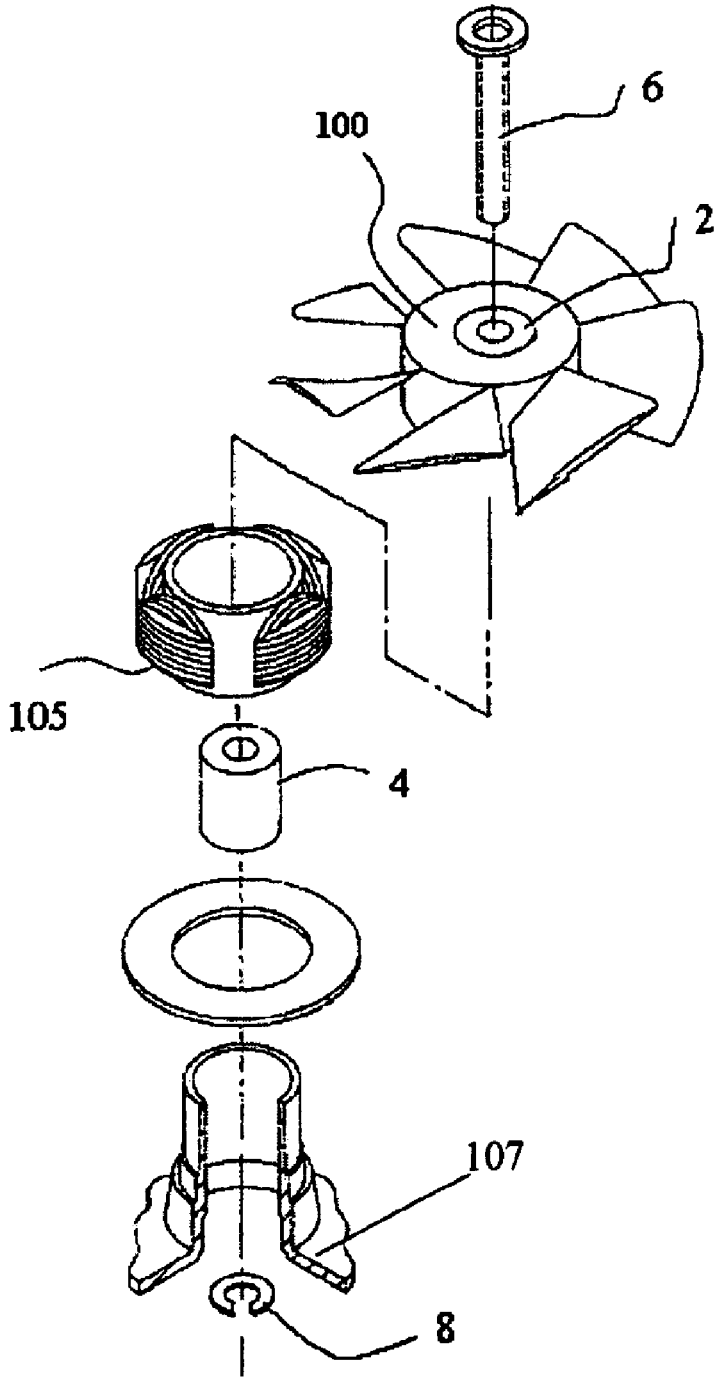
FIG. 2 shows an exploded view of the present invention.

FIG. 2 shows an exploded view of the present invention. Hollow ceramic tube bearing 2 passes through and is concentrically and fixedly attached to fan rotor 100, thereby rotating with the rotor. Hollow ceramic tubular support bearing 4 is fixedly mounted onto fan base 107. Axle tube 6 is cylindrical in shape, or with an end flange portion, forming a T-shaped (in cross-section) tube, which passes through the inside of bearing 2 and support bearing 4, and rotates slowly and asynchronously with rotor 100. Ceramic holding ring 8 has an opening or gap, and is installed at the end of axle tube 6, opposite rotor 100, to limit axial movement of axle tube 6.

When the fan is energized and rotating, bearing 2 rotates with rotor 100, and axle tube 6 is carried forward asynchronously, thereby rotating slowly within bearing 2 and support bearing 4. Since bearing 2 and axle tube 6 are rotating at different speeds in the same direction, this will greatly reduce friction and increase fan speed and efficiency. To avoid movement of axle tube 6 in the axial direction, a ceramic holding ring 8 (a C-ring) is installed at the end of the axle tube. The combination of rotating bearing 2, fixed bearing 4, free-moving axle tube 6 (allowing slow rotation) and auto balancing of magnetic force creates a stable high-speed rotating mechanism with minimum vibration and friction.

Axle tube 6 is held in place by the flange at its end that contacts fan rotor 100, along with retaining ring 8 at its other end. Given the orientation of the blades attached to fan rotor 100, the motion of rotor 100 would cause it to fly away from the body of the fan, if it were not otherwise held in place. The flange on axle tube 6 prevents this. Retaining ring 8 holds axle tube in place at its other end, near the motor stator. The combination of these elements holds axle tube 6 in place, by permitting a small amount of translational play. If axle tube 6 were held tightly in place, it would not be able to rotate at all. This would defeat the primary object of the invention.

Figure 3A:
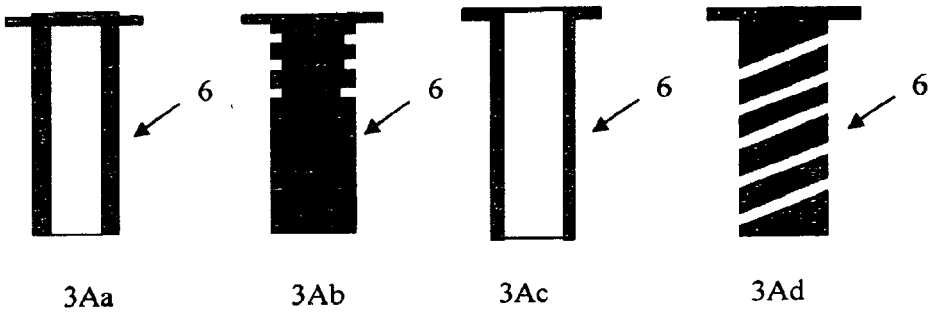
FIGS. 3Aa through 3Ad show cross-sectional views of various axle tubes used in the practice of the present invention.
Figure 3B:
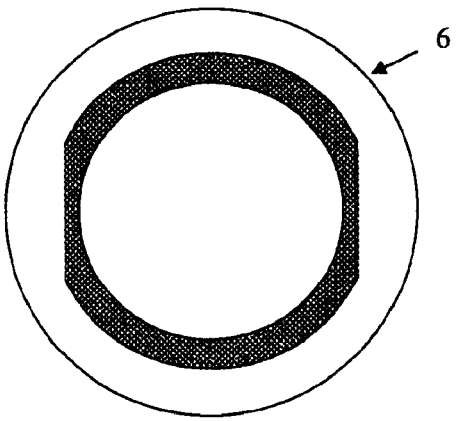
FIG. 3B shows a bottom view of the axle tube used in the present invention.
Figure 3C:
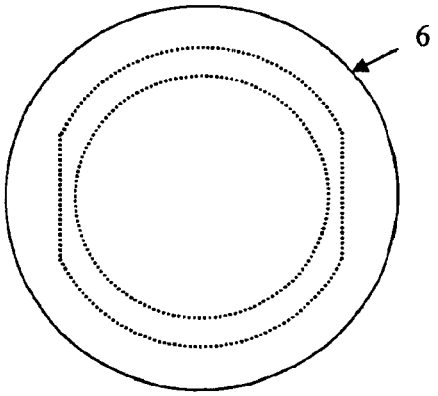
FIG. 3C shows a top view of the axle tube used in the present invention.

FIGS. 3A, 3B and 3C show the cross-sectional, bottom and top views, respectively, of ceramic axle tube 6. The exterior of axle tube 6 is ground or otherwise formed with concave grooves or with a non-circular shape to reduce surface contact between bearing 2, support bearing 4 and axle tube 6, thereby reducing friction. With these designs, contact between axle tube 6 and the two bearings occurs at only a few designated points, and not along the entire length of the bearings. Compared to contact along the entire lengths of the bearings, surface area of contact is reduced in the present invention, thereby also reducing friction between axle tube 6 and the bearings within which it rotates.

Figure 4A:
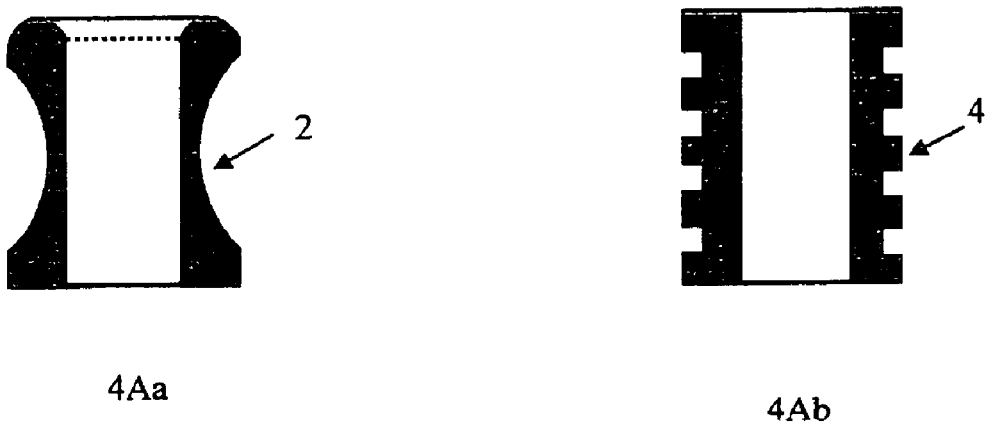
FIGS. 4A (consisting of subfigures 4Aa and 4Ab) and 4B (consisting of subfigures 4Ba and 4Bb) show top views of altenate structure of the bearing and support bearing, respectively.
Figure 4B:
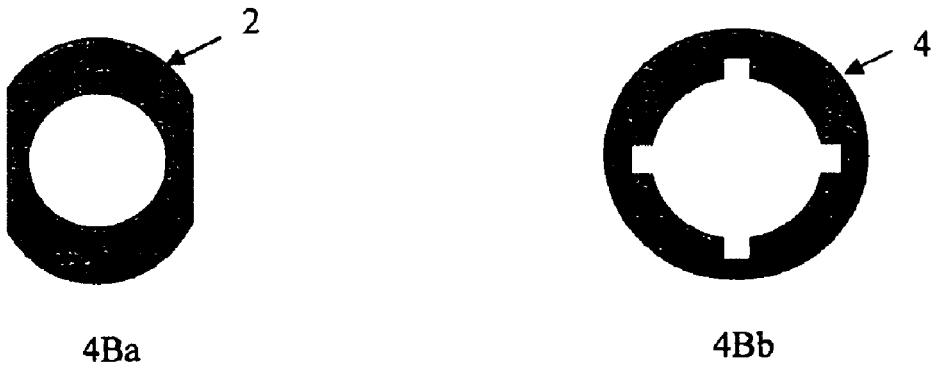
FIG. 4C shows a cross-sectional view of an embedded ceramic bearing in an injection-molded fan rotor.

FIGS. 4A (consisting of subfigures 4Aa and 4Ab) and 4B (consisting of subfigures 4Ba and 4Bb) show cross-sectional top views of bearing 2 and support bearing 4, respectively. The exteriors of bearing 2 and support bearing 4 are formed with a concave surface or grooved shape to provide a solid connection with fan rotor 100. The concave or grooved shape facilitates the attachment of ceramic bearings 2 and 4 to plastic rotor 100 and to fan base 107. The present invention is useful in producing small and thin fans.

Figure 4C:
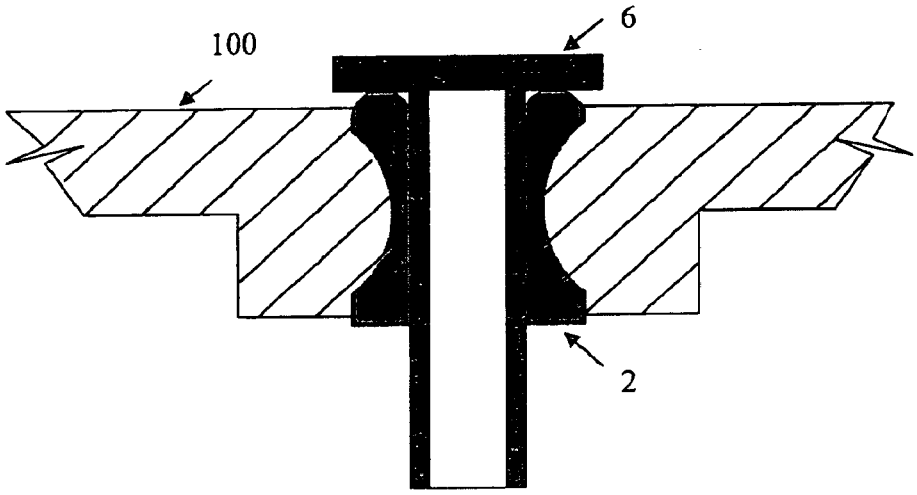

FIG. 4C shows a cross-sectional view of ceramic bearing 2 embedded into injection-molded fan rotor 100. The exterior of bearing 2 and support bearing 4 are formed with a concave surface or grooved shape to provide a solid connection with fan rotor 100. The concave or grooved shape facilitates the attachment of ceramic bearings 2 and 4 to plastic fan rotor 100 or fan base 107. The present invention is useful in producing small and thin fans.

Figure 5:
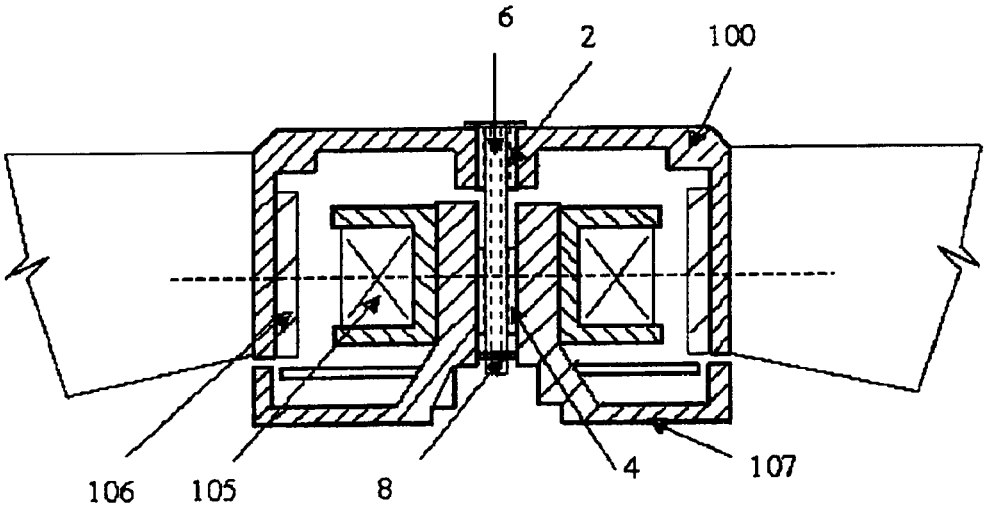
FIG. 5 shows a cross-sectional view of the present invention.

FIG. 5 shows a cross-sectional view of the present invention. Bearing 2 passes through and is concentrically and fixedly attached to fan rotor 100, and rotates with rotor 100. It should be noted that a portion of rotor 100 surrounds permanent magnet 106, forming a case for the magnet. Support bearing 4 is fixedly attached to fan base 107, providing structural support, and does not rotate. Axle tube 6 functions as structural support to provide a rotating support mechanism with multipoint contact. Ceramic holding ring 8 has an opening or gap and is installed at one end of axle tube 6 to limit axial movement of axle tube 6. Friction is further reduced by the balancing of magnetic forces between stator coil 105 and permanent magnet 106.

It should be noted that fan rotor 100 never comes in contact with the top surface of base 107 when the fan is operating. Rotation of the blades attached to rotor 100 would push rotor 100 in a frontward direction, if translational movement of rotor 100 were not otherwise constrained. The flange at the end of axle tube 6 prevents axle tube 6 from losing contact with rotor 100. At the same time, retaining ring 8 keeps rotor 100 from pulling axle tube 6 too far away from fan base 107. Axle tube 6, therefore, is constantly held in place during fan operation. In the practice of the invention, axle tube 6 is sufficiently long to maintain a gap between rotor 100 and fan base 107, so rotor 100 and fan base 107 never touch. Furthermore, the balance between magnetic forces in stator coil 105 and rotor magnet 106 helps to maintain placement of rotor 100 and fan base 107, keeping them apart.

There is no special restriction to the manufacturing process used to make hollow ceramic tube bearing 2, support bearing 4, ceramic axle tube 6 or ceramic holding ring 8 in the present invention. The preferred embodiments of the present invention use metal oxide ceramic powders (e.g. aluminum oxide, zirconium oxide, silicon oxide, etc.) or a mixture of two or more oxide powders, formulated with binding materials known in the art. After molding, fragile ceramic "green bodies" are debinded at "low" temperature (about 200–300 degrees Celsius, producing "brown bodies"), then sintered at high temperature (over 3000 degrees Celsius) to produce objects of high mechanical strength and durable ceramic blanks. Ceramic blanks require further precision processing to shape them into the components used in the present invention. These blanks are then ground and polished to achieve nearly true circular shape, to maintain low vibration and low-noise rotation. Ceramic holding rings 8 are made from ceramic blanks by slicing them into circular rings, then cutting an opening on each ring.

Compared with the prior art, the advances of the present invention may be summarized as follows:

The present invention provides improved structural support for the rotation mechanism of a heat-dissipation fan by utilizing durable and high mechanical strength ceramic for bearings, support bearings and axle tubes, to replace high-priced ball bearings or low-quality metal sleeves. In addition, various bearing and axle tube supporting structures are provided, and interior and exterior surfaces of bearings and axle tubes are further processed to reduce rotational friction. This results in a new heat-dissipation fan with lower noise, lower power consumption, longer life and higher rotational speed.

The present invention provides a useful mass production method for manufacturing small and thin rotor fans. The exterior surfaces of bearings and support bearings are ground or otherwise formed with concave surfaces or grooved shapes to provide a simple but solid connection with the fan rotor body. This is suitable for mass production of injection-molded fan rotor bodies with the bearings embedded therein.

The central novelty of the present invention is that the pin which fits between the two bearings is not fixed to either of them. Instead, it is free to rotate at a rotational speed different from that of the fan rotor itself. In practice, this pin (axle tube) rotates slowly, in the same direction as the fan rotor. This reduces friction greatly, compared to conventional fans. The other benefits of the fan described in the present invention have been discussed.

The present invention has been described using the foregoing embodiment. However, it is to be understood that the scope of the present invention is not limited to the disclosed embodiment. On the contrary, it is intended to cover various modifications and similar arrangements. The scope of the claims, therefore, should be accorded the broadest interpretation so as to encompass all such modifications and similar arrangements.

We claim:

1. A heat-dissipation fan, comprising:

a. a rotor, further comprising a permanent magnet surrounding the center of said rotor, a case surrounding said magnet, a plurality of fan blades radiating outwardly from said case, and a hollow tubular bearing, fixedly and concentrically mounted to said rotor;

b. a base member of said fan, further comprising a case in which said fan is mounted, a stator coil wound around the center of said base member which generates magnetic forces when said fan is in operation, a means for energizing said coil when said fan is in operation and a hollow turbular bearing fixedly mounted to said fan base, said bearing mounted in such a position on said fan base, so as to form a linear tubular opening when said fan rotor is placed next to said fan base for normal fan operation;

c. a cylindrical axial tube of sufficient length to fit through the bearing mounted to said rotor and the bearing mounted to said fan base, with sufficient excess length to allow the end of said axial tube to protrude form said fan base when the other end of said axial tube is placed loosely against the bearing mounted to said fan rotor; and d. a retaining ring placed around said axial tube at the end of said axial tube which protrudes from said fan base.

2. The apparatus as in claim 1, in which said axial tube is not fixedly attached to either of the aforementioned bearings, but is permitted to rotate freely within the space available to it when it is received by the two aforementioned bearings.

3. The apparatus as in claim 2, in which the separation between the exterior surface of said axial tube and the interior surfaces of the two aforementioned bearings is ten microns or less.

4. The apparatus as in claim 1, in which said axial tube further comprises a flange at one end thereof, for placement in proximity with the rotor of said fan.

5. The apparatus as in claim 4, in which the exterior surface of said axial tube is of a concave shape.

6. The apparatus as in claim 1, in which said retaining ring does not contain the shape of a complete circle, but contains a gap in the circular structure.

7. The apparatus as in claim 1, in which said bearings, axial tube and retaining ring are made of ceramic material.

8. The apparatus as in claim 7, in which said ceramic material is composed of a substance taken from the group consisting of aluminum oxide, zirconium oxide or silicon oxide.

9. The apparatus as in claim 5, in which the exterior surface of said axial tube is grooved.

10. The apparatus as in claim 8, in which said ceramic material is composed of a combination of the substances mentioned in claim 8.

11. A heat-dissipation fan comprising a rotor, a fan base and a rotation support apparatus for said fan; said rotation support apparatus further comprising a bearing fixedly mounted to the rotor of said fan, a bearing fixedly mounted to the base of said fan, an axial tube which fits inside said bearings, and a retaining ring located in proximity to said fan base, and which holds said axial tube in place, where the improvement consists of the ability of said axial tube to rotate freely when it is placed inside said bearings, with the result that said axial tube rotates slowly and asynchronously with the rotor of said fan when said fan is in operation.

* * * * *